US010370767B2

(12) United States Patent
Aust et al.

(10) Patent No.: US 10,370,767 B2
(45) Date of Patent: Aug. 6, 2019

(54) PROCESS FOR PREPARING ALCOHOLS BY ELECTROCHEMICAL REDUCTIVE COUPLING

(71) Applicant: BASF SE, Ludwigshafen (DE)

(72) Inventors: Nicola Christiane Aust, Mannheim (DE); Ulrich Griesbach, Mannheim (DE); Ralf Pelzer, Fürstenberg (DE); Thomas Haag, Hochspeyer (DE); Ulrich Berens, Binzen (DE); Jörg Botzem, Limburgerhof (DE)

(73) Assignee: BASF SE, Ludwigshafen am Rhein (DE)

( * ) Notice: Subject to any disclaimer, the term of this patent is extended or adjusted under 35 U.S.C. 154(b) by 160 days.

(21) Appl. No.: 15/503,459

(22) PCT Filed: Aug. 12, 2015

(86) PCT No.: PCT/EP2015/068574
§ 371 (c)(1),
(2) Date: Feb. 13, 2017

(87) PCT Pub. No.: WO2016/023951
PCT Pub. Date: Feb. 18, 2016

(65) Prior Publication Data

US 2017/0233874 A1 Aug. 17, 2017

(30) Foreign Application Priority Data

Aug. 14, 2014 (EP) ..... 14181057

(51) Int. Cl.
*C25B 3/10* (2006.01)

(52) U.S. Cl.
CPC ..... *C25B 3/10* (2013.01)

(58) Field of Classification Search
CPC ..... C25B 3/10; C07B 31/00; C07B 35/02; C07B 41/02
See application file for complete search history.

(56) References Cited

U.S. PATENT DOCUMENTS 4,748,095 A 5/1988 Furuya et al.
4,931,168 A 6/1990 Watanabe et al.
5,593,557 A 1/1997 Sopher et al.
5,618,392 A 4/1997 Furuya
6,267,865 B1 7/2001 Polson et al.

FOREIGN PATENT DOCUMENTS

EP 635587 A1 1/1995
JP S57143481 A 9/1982
WO WO-2009071478 A1 6/2009

OTHER PUBLICATIONS

English translation of JP S57-143481 A (Year: 1982).*
Baizer, M. "The electrochemical route to adiponitrile-1 discovery", Chemtech, (1980), pp. 161-164.
Beck, F. et al , "Entwicklung neuer Zellen für elektro-organische Synthesen", Chemie Ingenieur Technik, vol. 41, No. 17. (1969) pp. 943-950.
Danly, D., "Processes for Electrohydrodimerization of Acrylonitrile to Adiponitrile", AIChE Symposium Series, American Institute of Chemical Engineers, vol. 77, No. 204, (1981), pp. 39-44.
International Search Report for PCT/EP2015/068574 dated Oct. 28, 2015.
Makarochkina, S., et al., "Cathodic Hydrocodimerization Reactions", Journal of General Chemistry USSR, Consultants Bureau, New York, NY, vol. 44, (1974), pp. 2523-2525.
Nicolas, M., et al., "Preparation of some tertiary alcohols by electrochemical reduction followed by a coupling reaction of an acetone-olefin mixture" (in French), Compte Rendus des Seances de l'Academie des Sciences, Serie C: Sciences Chimiques, Elsevier France, Editions Scientifiques et Medicales, vol. 265, No. 19, (1967), pp. 1044-1047.
Nielsen, M,. et al., "Reductive Coupling", in Organic Electrochemistry, Fourth Edition, Revised and Expanded: Lund, H., Hammerich, O., eds.; Marcel Dekker, Inc.: New York, 2001, 99. 795-882.
Schnatbaum, K., et al., "Electroorganic Synthesis 66: Selective Anodic Oxidation of Carbohydrates Mediated by TEMPO", Synthesis 1999, vol. 5, (1999), pp. 864-872.
Written Opinion of the International Searching Authority for PCT/EP2015/068574 dated Oct. 28, 2015.

* cited by examiner

*Primary Examiner* — J. Christopher Ball
(74) *Attorney, Agent, or Firm* — Drinker Biddle & Reath LLP

(57) ABSTRACT

Alcohols are prepared by electrochemical reductive coupling of an aromatic vinyl compound and a carbonyl compound in a process which comprises electrolyzing an electrolyte solution in an electrochemical cell, the electrolyte solution comprising the aromatic vinyl compound, the carbonyl compound and a non-aqueous protic solvent, such as methanol, wherein the electrolyte solution is in contact with a carbon-based cathode. Styrene is reacted with acetone to prepare 2-methyl-4-phenyl-2-butanol.

19 Claims, No Drawings

PROCESS FOR PREPARING ALCOHOLS BY ELECTROCHEMICAL REDUCTIVE COUPLING

CROSS-REFERENCE TO RELATED APPLICATIONS

This application is a national stage application (under 35 U.S.C. § 371) of PCT/EP2015/068574, filed Aug. 12, 2015, which claims benefit of European Application No. 1.4181057.2, filed Aug. 14, 2014, both applications of which are incorporated herein by reference in their entirety.

FIELD OF THE INVENTION

The present invention relates to a process for preparing alcohols by electrochemical reductive coupling of an aromatic vinyl compound and a carbonyl compound.

BACKGROUND OF THE INVENTION

Electrochemical reductive coupling is an important type of carbon-carbon bond-forming reactions. A large variety of starting materials has been employed successfully. Substituted olefins are an important class of these compounds. They can hydrodimerize with themselves or couple with other compounds, such as carbonyl compounds.

An industrially important example of an electrohydrodimerization reaction is the electrosynthesis of adiponitrile, an important precursor of nylon-6,6 (M. M. Baizer, Chemtech 1980, 10, 161; D. E. Danly, AIChE Symposium Series 1981, 77, 39).

The cathodic surface of the electrochemical cell must have a cathodic potential sufficient for the electrochemical reduction of a substrate. The electrochemical reduction of the substrate, e.g., the olefinic compound, competes with the reduction of protons which are present in the electrolyte solution and also necessary for the electrosynthesis pathway. Successful reductive coupling requires that one substrate is reduced preferentially over the protons in the first step. Water is in many cases the preferred proton source. To gain good selectivities and yields, electrode materials with a high hydrogen overpotential are conventionally used, such as lead or mercury electrodes (M. F. Nielsen, J. H. P. Utley, in Organic Electrochemistry, 4th ed., 2001, 795, H. Lund, O. Hammerich, Eds., Marcel Dekker, New York).

S. M. Makarochkina and A. P. Tomilov (J. Gen. Chem. USSR 1974, 44, 2523) disclose that tertiary alcohols with various functional groups can be obtained by the reductive coupling of aliphatic ketones with activated olefins in a divided cell, utilizing mercury or graphite cathodes. Alkenes without electron-withdrawing groups, such as styrene, generally give poor coupling yields.

M. Nicolas and R. Pallaud (C. R. Acad. Sc. Paris 1967, 265, Série C, 1044) disclose the use of a mercury electrode in an aqueous electrolyte for the electrochemical reductive coupling of acetone and styrene, yielding 2-methyl-4-phenyl-2-butanol. While mercury cathodes may lead to increased yields, their use can be problematic, e.g. due to the ecologically troublesome accumulation of mercury-containing waste.

DETAILED DESCRIPTION OF THE INVENTION

The object of the invention is to provide a high-yielding, ecologically advantageous process for the electrochemical reductive coupling of aromatic vinyl compounds and carbonyl compounds.

The present invention provides a process for preparing alcohols by electrochemical reductive coupling of an aromatic vinyl compound and a carbonyl compound, which comprises electrolyzing an electrolyte solution in an electrochemical cell, the electrolyte solution comprising the aromatic vinyl compound, the carbonyl compound and a non-aqueous protic solvent, wherein the electrolyte solution is in contact with a carbon-based cathode.

The reaction of the process according to the invention is illustrated by the following equation:

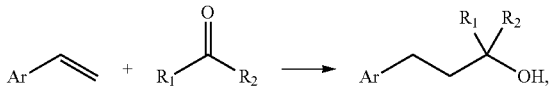

wherein the residues Ar, $R^1$ and $R^2$ are defined as described below.

The aromatic vinyl compound useful in the process according to the invention comprises a vinylic group bound to an aryl moiety Ar. The aryl moiety Ar may be a phenyl or naphthyl ring system. The aryl moiety Ar may be substituted with non-interfering groups. The term "non-interfering substituent" is employed herein to mean a substituent which can be present in the aromatic vinyl compound without causing substantial adverse alteration of either the course of the desired reductive coupling of such aromatic vinyl compounds or the yield of the desired product under process conditions. Representative non-interfering substituents are, e.g., $G_{1-8}$-alkyl, $C_{3-8}$-carbocyclyl, $C_{1-8}$-heterocyclyl, or $C_{1-8}$-heterocyclylalkyl. The alkyls may be straight chain alkyl or branched alkyl.

Suitable aromatic vinyl compounds are, for example, styrene, styrene derivatives such as $C_{1-8}$-alkyl styrenes, e.g. α-, β-, 2-, 3- or 4-methyl styrene, or di- and tri-methyl styrenes in any substitution pattern. A preferred aromatic vinyl compound is styrene.

The carbonyl compound useful in the process according to the invention is an aldehyde or a ketone. It comprises a carbonyl group, to which substituents $R_1$ and $R_2$ are bound. $R_1$ and $R_2$ are preferably hydrogen atoms or alkyl groups, to which non-interfering substituents may be bound. Particularly preferred are compounds $R_1$—CO—$R_2$ in which $R_1$ and $R_2$ are each independently hydrogen, $C_{1-8}$-alkyl or -alkylenyl, such as methyl, ethyl, propyl, butyl, pentyl, pentenyl, hexyl or hexenyl, $C_{3-8}$-carbocyclyl or -carbocyclenyl, such as cyclopropanyl, cyclobutanyl, cyclopentanyl, cyclopentenyl, cyclohexanyl, cyclohexenyl or benzyl, $C_{4-8}$-carbocyclylalkyl or -carbocyclenylalkyl, such as methyl-, ethyl-, or propylcyclopentanyl, methyl-, ethyl-, or propylcyclopentenyl, methyl-, ethyl-, or propylcyclohexanyl, methyl-, ethyl-, or propylcyclohexenyl, or methyl-, ethyl-, or propylbenzyl, $C_{1-8}$-heterocyclyl or -heterocyclenyl such as aziridinyl, dioxetanyl, furanyl, imidazolyl, morpholinyl or pyridinyl, or $C_{2-8}$-heterocyclylalkyl or -heterocyclenylalkyl, such as methyl-, ethyl-, or propylaziridinyl, methyl-, ethyl-, or propyldioxetanyl, methyl-, ethyl-, or propylfuranyl, methyl-, ethyl-, or propylimidazolyl, or methyl-, ethyl-, or propylmorpholinyl, or $R_1$ and $R_2$ together form a saturated or unsaturated carbocycle or heterocycle. The alkyls may be straight chain alkyl or branched alkyl.

Suitable carbonyl compounds are, for example, pentanal, 2-methylpentanal, hexanal, 2-ethylhexanal, heptanal, 4-formyltetrahydropyran, 4-methoxybenzaldehyde, 4-tert-butylbenzaldehyde, 4-methylbenzaldehyde, glutaraldehyde, cyclohexenone, cyclohexanone, acetone, and diethyl ketone.

Preferred carbonyl compounds are cyclo-hexenone, cyclohexanone, acetone, and diethyl ketone. Particularly preferred are carbonyl compounds having a total of 3 to 8 carbon atoms, which in addition to the carbonyl group comprise no further heteroatoms. An especially preferred carbonyl compound is acetone.

Typically, the molar ratio of carbonyl compound to aromatic vinyl compound in the electrolyte solution is in the range of 20 to 4, preferably in the range of 15 to 4, particularly preferred in the range of 13 to 6. Preferably, the aromatic vinyl compound concentration is from 1 to 25% by weight, more preferably 5 to 20% by weight, based on the total weight of electrolyte solution. At higher concentrations, unwanted dimerization of the aromatic vinyl compounds comes to the fore; lower concentrations render the process economically unattractive.

The electrolyte solution comprises the aromatic vinyl compound and the carbonyl compound as a homogeneous solution, i.e., molecularly dissolved, or as a colloidal solution.

The electrolyte solution further comprises a non-aqueous protic solvent. A protic solvent is a solvent that has a hydrogen atom bound to an oxygen (as in a hydroxyl group) or a nitrogen (as in an amide group). The molecules of such solvents readily donate protons (H+) necessary in the reaction pathway. The non-aqueous protic solvent is preferably selected from alcohols, primary and secondary amines, and primary and secondary amides. Particularly preferred, the non-aqueous protic solvent is an alcohol, for example a $C_{1-3}$ primary alcohol. Especially preferred, the non-aqueous protic solvent is methanol. Preferably, the electrolyte solution contains less than 5% by weight of water, in particular less than 2% by weight of water, based on the total weight of the electrolyte solution.

Generally, the electrolyte solution comprises a conducting salt. Conducting salts support charge transport and reduce ohmic resistance. It does not take part in the electrode reactions. Preferably, the conducting salt is comprised in an amount in the range of 0.1 to 20% by weight, preferably 0.2 to 15% by weight, more preferably 0.25 to 10% by weight, even more preferably 0.5 to 7.5% by weight and especially preferably 1.0 to 6.0% by weight based on the total weight of the electrolyte solution.

Particularly suitable conducting salts are quaternary ammonium salts, such as tetrabutylammonium or ethyltributylammonium salts, quaternary phosphonium salts, and bis-quaternary ammonium and phosphonium salts such as hexamethylene bis(dibutyl ethyl ammonium hydroxide) (EP 635 587 A). Sulfate, hydrogen sulfate, alkyl sulfates, aryl sulfates, alkyl sulfonates, aryl sulfonates, halides, phosphates, carbonates, alkyl phosphates, alkyl carbonates, nitrates, alkoxides, hydroxide, tetrafluoroborate or perchlorate may be employed as the counter ion. Additionally, ionic liquids may be used as conducting salts. Suitable ionic liquids are described in "Ionic Liquids in Synthesis", ed. Peter Wasserscheid, Tom Welton, Wiley V C H, 2003, ch. 1 to 3.

In an embodiment of the inventive process, the electrolyte solution comprises a stable radical compound. Stable radical compounds are molecules with odd electrons which are persistent or, in other words, do not undergo spontaneous dimerization or rearrangement.

Preferably, the stable radical compound is a stable organic radical compound, especially a nitroxyl radical. A suitable stable radical compound is (2,2,6,6-tetramethyl-piperidin-1-yl)oxyl (TEMPO) and 4-hydroxy-2,2,6,6-tetramethylpiperidin-1-oxyl (OH-TEMPO). Stable radical compounds may serve as mediators of electron transfer at the anode. With the use of a mediator, different selectivity can be achieved. In the process of the present invention, the oxidation of the non-aqueous solvent competes with the oxidation of the aromatic vinyl compound at the anode. Including a stable radical compound can be effective to supress oxidation of the aromatic vinyl compound. Instead, the anodic reaction is shifted towards the oxidation of the non-aqueous solvent, e.g. methanol to formaldehyde.

In accordance with the present process, an electric current is passed through the electrolyte solution in an electrochemical cell. Preferably, the electrochemical cell is an undivided electrochemical cell. The use of an undivided electrochemical cell provides significant advantages. A divided cell is inherently more complex than an undivided cell, thereby involving higher costs in cell construction. A divided cell exhibits a higher internal resistance than an undivided cell resulting in substantially higher power costs. Further, an undivided cell has a longer cell life time, as the diaphragms employed in divided electrochemical cells tend to age rapidly.

The process of the present invention is carried out in an electrochemical cell comprising an anode and a cathode. The individual electrodes can be connected in parallel (monopolar) or serially (bipolar). The type of electrochemical cell employed in the process of the instant invention is not critical provided adequate mixing and circulation can be maintained. One or more free-standing anodes and cathodes may be connected to a source of direct electric current such as a battery and the like.

Customary undivided electrolysis cells are preferred, such as beaker or plate-and-frame cells or cells with fixed bed or fluidized bed electrodes. In a preferred embodiment, the electrochemical cell is a plate-and-frame cell. This type of cell is composed essentially of usually rectangular electrode plates and frames which surround them. They can be made of polymer material, for example polyethylene, polypropylene, polyvinyl chloride, polyvinylidene fluoride, PTFE, etc. The electrode plate and the associated frame are frequently joined to each other to form an assembly unit. By pressing a plurality of such plate-and-frame units together, a stack which is assembled according to the constructional fashion of filter presses is obtained. Yet further frame units, for example for receiving spacing gauzes, etc. can be inserted in the stack.

The cell can also be a capillary gap cell as described by F. Beck and H. Guthke in Chem.-Ing.-Techn. 1969, 41, 943-950. A capillary gap cell contains a stack of bipolar rectangular or circular electrode disks, which are separated by non-conducting spacers. The electrolyte solution enters the circular stack via a central channel and is radially distributed between the electrodes.

In the process according to the present invention, the cathode is a carbon-based electrode. A carbon-based electrode is intended to mean an electrode containing carbon or other carbon-based material surface which, in use, is exposed to the electrolyte solution in the cell. Preferably the carbon or other carbon-based material has an open porosity which extends to the surfaces of the electrode. The carbon-based cathode is, e.g., a graphite electrode, a gas diffusion layer electrode, or a carbon felt electrode or graphite felt electrode.

In one preferred embodiment, the carbon-based cathode is a graphite electrode. Graphite electrodes comprise porous and/or dense graphite material. In another preferred embodiment, the carbon-based cathode is a gas diffusion layer (GDL) electrode. GDLs are commercially available. Suitable GDLs are described inter alfa in U.S. Pat. Nos. 4,748,095, 4,931,168 and 5,618,392. Suitable commercially available GDLs are e.g of the H2315 series from Freudenberg FCCT KG, Huhner Weg 2-4, 69465 Weinheim, Germany. A GDL generally comprises a fibre layer or substrate and a microporous layer (MPL) consisting of carbon particles attached to each other. The degree of hydrophobization can vary in such a way that wetting and gas permeability can be adjusted. GDL electrodes for the process of the invention preferably do not contain a catalyst supported on the surface of the electrode.

Although GDLs are usually employed in gaseous applications such as fuel cells, it was found that they exhibit good electrode performance in anodic substitution reactions, like selective fluorination or alkoxylation reactions in an electrolyte solution, and now in reductive coupling reactions. Beneficially, the hydrogen generation of a GDL cathode in an electrolyte solution is relatively poor, facilitating the preferential reduction of the substrate over the protons in the first step of the reductive coupling reaction.

The anode employed in the process of the present invention can be constructed of a wide variety of conductive materials. Thus, anode materials suitable for use in the present process include, for example, steel, metal oxide, carbon, and the like. Preferably, the anode is a carbon-based anode. The carbon-based anode is, e.g., a graphite electrode, a gas diffusion layer electrode, or a carbon felt electrode or graphite felt electrode.

The current density applied is in ranges known to the expert. Preferably, the current density employed is in a range of from 1 to 25 A/dm$^2$, more preferably, in the range of from 1 to 10 A/dm$^2$.

Preferably, the electrochemical reductive coupling reaction is performed with a constant current applied; i.e. at a constant voltage or a constant current flow. It is of course also possible to interrupt the electric current through a current cycle, as described in U.S. Pat. No. 6,267,865.

The electrolysis is usually conducted at a temperature of 5 to 60° C. and under atmospheric or slightly elevated pressure.

The process is suited to either batch, semibatch or continuous operation. The alcohol can be separated from the electrolyte solution by customary methods, preferably by distillation. In a continuous process, a part of the electrolyte solution can be continuously be discharged from the electrochemical cell and the alcohol recovered therefrom.

The distillation can be carried out by customary methods known to those skilled in the art. Suitable apparatuses for the fractionation by distillation comprise distillation columns such as tray columns, which can be provided with bubble caps, sieve plates, sieve trays, packings, internals, valves, side offtakes, etc. Dividing wall columns, which may be provided with side offtakes, recirculations, etc., are especially suitable. A combination of two or more than two distillation columns can be used for the distillation. Further suitable apparatuses are evaporators such as thin film evaporators, falling film evaporators, Sambay evaporators, etc., and combinations thereof.

An embodiment of the process according to the invention relates to the preparation of 2-methyl-4-phenyl-2-butanol, wherein the aromatic vinyl compound is styrene and the carbonyl compound is acetone. The 2-methyl-4-phenyl-2-butanol may be subsequently hydrogenated by conventional methods to 2-methyl-4-cyclohexyl-2-butanol. 2-Methyl-4-cyclohexyl-2-butanol (Coranol) is a fragrance with a flowery odor that is used in the preparation of perfumes and perfumed materials.

The following examples serve to further illustrate the present invention.

EXAMPLES

The GDLs employed in the examples were non-commercial. The results of the measurements for examples 1 to 9 are listed in table 1.

Abbreviations Used

BT: beaker type cell

CG: capillary gap (cell)

GDL: gas diffusion layer

MTBS: methyltributylammonium methyl sulfate

OH-TEMPO: 4-Hydroxy-TEMPO

PF: plate-and-frame (cell)

Example E1

In a 100 mL undivided beaker type electrolysis cell, 4.2 g of styrene (8 weight-%), 22.4 g of acetone (42 weight-%) and 3.2 g of MTBS (methyltributylammonium methyl sulfate, 6 weight-%) as conducting salt in 23.2 g of methanol (44 weight-%) were electrolyzed with 34 mA/cm$^2$ for 1.2 Faraday using a graphite felt anode and a GDL cathode. The GC analysis showed 100% styrene conversion and a selectivity to Carbinol Muguet of 32%, this corresponds to a yield of 32% and a current yield of 53% (see table 1).

Comparative Example CE1

In a 100 mL undivided beaker type electrolysis cell, 4.7 g of styrene (8 weight-%), 25.3 g of acetone (42 weight-%) and 3.6 g of MTBS (methyltributylammonium methyl sulfate, 6 weight-%) as conducting salt in 26.4 g of water (44 weight-%) were electrolyzed with 34 mA/cm$^2$ for 1.1 Faraday using a graphite felt anode and a GDL cathode. The GC analysis showed 95% styrene conversion and a selectivity to Carbinol Muguet of 25%, this corresponds to a yield of 24% and a current yield of 43% (see table 1).

Example E2

In a 100 mL undivided beaker type electrolysis cell, 4.0 g of styrene (8 weight-%), 21.6 g of acetone (42 weight-%), 3.1 g of MTBS (methyltributylammonium methyl sulfate, 6 weight-%) as conducting salt and 0.3 g of TEMPO (0.5 weight-%) in 22.4 g of methanol (44 weight-%) were electrolyzed with 34 mA/cm$^2$ for 5 Faraday using a graphite felt anode and a GDL cathode. The GC analysis showed 92% styrene conversion and a selectivity to Carbinol Muguet of 60%, this corresponds to a yield of 55% and a current yield of 22% (see table 1).

Example E3 is a repetition of Example E2 and shows that the results are reproducible (see table 1).

TABLE 1

Electrochemical reductive coupling of acetone and styrene

| # | additive/conducting salt | acetone [wt.-%] | styrene [wt.-%] | solvent/ wt.-% | conversion of styrene [%] | selectivity [%] | yield [%] | current yield [%] |
|---|---|---|---|---|---|---|---|---|
| E1 | —/6% MTBS | 42 | 8 | MeOH/44 | 100 | 32 | 32 | 53 |
| CE1 | —/6% MTBS | 42 | 8 | water/44 | 95 | 25 | 24 | 43 |
| E2 | 0.5% TEMPO/6% MTBS | 42 | 8 | MeOH/44 | 92 | 60 | 55 | 22 |
| E3 | 0.5% TEMPO/6% MTBS | 42 | 8 | MeOH/44 | 97 | 56 | 54 | 27 |

From the comparison of examples E1 to E3 and comparative example CE1, it is clear that the use of methanol instead of water as the solvent has a favourable impact on the selectivity and yield of the reaction, as well as on the current yield. The use of TEMPO further improves selectivity and yield, while lowering the current yield.

Comparative Example CE2

In a 100 mL undivided beaker type electrolysis cell, 4.7 g of styrene (8 weight-%) and 34.2 g of acetone (57 weight-%) and 3.6 g of MTBS (methyltributylammonium methyl sulfate, 6 weight-%) in 17.1 g of water (29 weight-%) were electrolyzed with 34 mA/cm$^2$ for 1.8 Faraday using a graphite felt anode and a GDL cathode. The GC analysis showed 93% styrene conversion and a selectivity to Carbinol Muguet of 47%, this corresponds to a yield of 44% and a current yield of 49% (see table 2).

Comparative Example CE3

In a 100 mL undivided beaker type electrolysis cell, 7.0 g of styrene (10 weight-%), 42.0 g of acetone (60 weight-%) and 0.4 g of sodium acetate (0.6 weight-%) as conducting salt in 20.6 g of water (29 weight-%) were electrolyzed with 34 mA/cm$^2$ for 1.5 Faraday using a GDL anode and a GDL cathode. The GC analysis showed 95% styrene conversion and a selectivity to Carbinol Muguet of 40%, this corresponds to a current yield of 50%. The isolated yield was 38% (see table 2).

Example E4

In an undivided plate and frame cell with a graphite felt anode and a GDL cathode, 240 g of styrene (8 weight-%); 1260 g of acetone (42 weight-%), 120 g of MTBS (methyltributylammonium methyl sulfate, 4 weight-%) as conducting salt, and 15 g of OH-TEMPO (0.5 weight-%) in 1365 g methanol (45.5 weight-%) were electrolyzed with 34 mA/cm$^2$ for 4.2 Faraday. The GC analysis showed 97% styrene conversion and a selectivity to Carbinol Muguet of 69%, this corresponds to a yield of 67% and a current yield of 32% (see table 2).

Examples E5 and E6 are repetitions of Example E4 and show that the results are reproducible (see table 2).

Example E7

In a capillary gap cell with two gaps formed by graphite electrodes (147 cm$^2$), a feed of 30.2 g/h of styrene, 168 g/h of acetone, 176 g/h of methanol and 12.9 g/h of MTBS 60% in methanol (Feed: 8 weight-% styrene, 43 weight-% acetone, 47 weight-% methanol, 2 weight-% MTBS) was electrolyzed with 34 mA/cm$^2$ in a continuous mode. This resulted in a styrene conversion of 84%, a selectivity of 45%, a yield of 38% and a current yield of 58% (see table 2).

Examples E8 to E10 were carried out analogously to Example E7; the varied parameters and results are listed in table 2.

Table 2 shows the results of the electrochemical reductive coupling of acetone and styrene of examples E1 to E10 and comparative examples CE1 to CE3.

TABLE 2

Electrochemical reductive coupling of acetone and styrene

| # | cell | anode | cathode | additive/conducting salt | acetone [wt.-%] | styrene [wt.-%] | solvent/ wt.-% | conversion of styrene [%] | selectivity [%] | yield [%] | current yield [%] |
|---|---|---|---|---|---|---|---|---|---|---|---|
| E1 | BT | graphite felt | GDL | —/6% MTBS | 42 | 8 | MeOH/44 | 100 | 32 | 32 | 53 |
| CE1 | BT | graphite felt | GDL | —/6% MTBS | 42 | 8 | water/44 | 95 | 25 | 24 | 43 |
| E2 | BT | graphite felt | GDL | 0.5% TEMPO/6% MTBS | 42 | 8 | MeOH/44 | 92 | 60 | 55 | 22 |
| E3 | BT | graphite felt | GDL | 0.5% TEMPO/6% MTBS | 42 | 8 | MeOH/44 | 97 | 56 | 54 | 27 |
| CE2 | BT | graphite felt | GDL | —/6% MTBS | 57 | 8 | water/29 | 93 | 47 | 44 | 49 |
| CE3 | BT | GDL | GDL | —/0.6% sodium acetate | 60 | 10 | water/29 | 95 | 40 | $38_{isol.}$ | 50 |
| E4 | PF | graphite felt | GDL | 0.5% OH-TEMPO/4% MTBS | 42 | 8 | MeOH/46 | 95 | 70 | 66 | 29 |
| E5 | PF | graphite felt | GDL | 0.5% OH-TEMPO/4% MTBS | 42 | 8 | MeOH/46 | 95 | 67 | 63 | 27 |
| E6 | PF | graphite felt | GDL | 0.5% OH-TEMPO/4% MTBS | 42 | 8 | MeOH/46 | 97 | 69 | 67 | 32 |
| E7 | CG | graphite | graphite | —/2% MTBS | 43 | 8 | MeOH/47 | 84 | 45 | 38 | 58 |
| E8 | CG | graphite felt | GDL | 0.5% OH-TEMPO/2% MTBS | 42 | 8 | MeOH/47 | 87 | 67 | 58 | 23 |
| E9 | CG | graphite felt | GDL | 0.2% OH-TEMPO/2% MTBS | 42 | 8 | MeOH/47 | 86 | 60 | 52 | 43 |
| E10 | CG | graphite felt | graphite | 0.5% OH-TEMPO/2% MTBS | 42 | 8 | MeOH/47 | 86 | 69 | 59 | 22 |

CE denotes a comparative example

Example E11

In a 100 mL undivided beaker type electrolysis cell, 3.7 g of styrene (8 weight-%); 20.3 g of methylethylketone (43 weight-%) and 1 g of MTBS (2 weight-%) as conducting salt in 21.8 g methanol (47 weight-%) were electrolyzed with 34 mA/cm$^2$ for 1.5 Faraday using graphite electrodes as the anode and the cathode. GCMS analysis shows 3-methyl-5-phenyl-3-pentanol as the major product peak.

Example E12

In a 100 mL undivided beaker type electrolysis cell, 3.3 g of styrene (8 weight-%), 18.1 g of 2-heptanone (41 weight-%) and 1.7 g of MTBS (2 weight-%) as conducting salt in 20.0 g of methanol (47 weight-%) were electrolyzed with 34 mA/cm$^2$ for 2 Faraday using graphite electrodes as the anode and the cathode. GCMS analysis shows 6-methyl-8-phenyl-6-octanol as the major product peak.

Example E13

In a 100 mL undivided beaker type electrolysis cell, 3.4 g of styrene (8 weight-%), 19.0 g of 2-nonanone (42 weight-%) and 1.8 g of MTBS (4 weight-%) as conducting salt in 21.0 g of methanol (47 weight-%) were electrolyzed with 34 mA/cm$^2$ for 2 Faraday using graphite electrodes as the anode and the cathode. GCMS analysis shows 8-methyl-10-phenyl-8-decanol as the major product peak.

Example E14

In a 100 mL undivided beaker type electrolysis cell, 4.0 g of styrene (8 weight-%); 23.5 g of cyclohexanone (46 weight-%) and 2.0 g of MTBS (4 weight-%) as conducting salt in 21.1 g of methanol (42 weight-%) were electrolyzed with 34 mA/cm$^2$ for 2 Faraday using a graphite electrode as the cathode and a graphite felt as the anode. GCMS analysis shows 1-(2-phenylethyl)-cyclohexanol as the major product peak.

Example E15

In a 100 mL undivided beaker type electrolysis cell, 3.7 g of styrene (8 weight-%), 19.1 g of cyclododecanone (46 weight-%) and 4.8 g of MTBS (10 weight-%) as conducting salt in 19.9 g of methanol (42 weight-%) were electrolyzed with 34 mA/cm$^2$ for 2 Faraday using a graphite electrode as the cathode and a graphite felt as the anode. GCMS analysis shows 1-(2-phenylethyl)-cyclododecanol as a product peak.

The invention claimed is:

1. A process for preparing an alcohol by electrochemical reductive coupling, the process comprising providing an electrolyte solution comprising an aromatic vinyl compound, a carbonyl compound, and a non-aqueous protic solvent in an electrochemical cell, and electrolyzing the electrolyte solution in the cell, wherein the electrolyte solution is in contact with a carbon-based cathode; and wherein the electrolyte solution contains less than 5% by weight of water.

2. The process of claim 1, wherein the non-aqueous protic solvent is an alcohol.

3. The process of claim 2, wherein the non-aqueous protic solvent is methanol.

4. The process of claim 1, wherein the carbon-based cathode is selected from the group consisting of a graphite electrode, a gas diffusion layer electrode, a carbon felt electrode and a graphite felt electrode.

5. The process of claim 1, wherein the anode is a carbon-based anode.

6. The process of claim 5, wherein the carbon-based anode is selected from the group consisting of a graphite electrode, a gas diffusion layer electrode, a carbon felt electrode and a graphite felt electrode.

7. The process of claim 1, wherein the electrolyte solution comprises a conducting salt.

8. The process of claim 7, wherein the conducting salt is a quaternary ammonium salt.

9. The process claim 1, wherein the electrolyte solution comprises a stable radical compound.

10. The process of claim 9, wherein the stable radical compound is a nitroxyl radical.

11. The process of claim 10, wherein the stable radical compound is (2,2,6,6-tetramethyl-piperidin-1-yl)oxyl or 4-hydroxy-2,2,6,6-tetramethylpiperidin-1-oxyl.

12. The process of claim 1, wherein the carbonyl compound is a ketone.

13. The process of claim 1, wherein the prepared alcohol is 2-methyl-4-phenyl-2-butanol, the aromatic vinyl compound is styrene, and the carbonyl compound is acetone.

14. A process of making 2-methyl-4-cyclohexyl-2-butanol by hydrogenation of the 2-methyl-4-phenyl 2-butanol prepared from the process of claim 13.

15. A process for preparing an alcohol by electrochemical reductive coupling, the process comprising providing an electrolyte solution including an aromatic vinyl compound, a carbonyl compound, a nitroxyl compound, a conducting salt, and a non-aqueous protic solvent in an electrochemical cell, and electrolyzing the electrolyte solution in the cell, wherein the electrolyte solution is in contact with a carbon-based cathode selected from the group consisting of a graphite electrode, a gas diffusion layer electrode, a carbon felt electrode and a graphite felt electrode;

wherein the electrolyte solution contains less than 5% by weight of water.

16. The process of claim 15, wherein the carbonyl compound is a ketone, and the aromatic vinyl compound is styrene.

17. The process of claim 16, wherein the carbonyl compound is acetone, and the prepared alcohol is 2-methyl-4-phenyl-2-butanol.

18. The process of claim 17, wherein the selectivity to 2-methyl-4-phenyl-2-butanol is in a range from 45% to 70%, based on conversion of the styrene.

19. 2-methyl-4-cyclohexyl-2-butanol prepared by hydrogenation of the 2-methyl-4-phenyl-2-butanol prepared from the process of claim 17.

* * * * *